US011251561B2

(12) United States Patent
Wallensteiner et al.

(10) Patent No.: US 11,251,561 B2
(45) Date of Patent: Feb. 15, 2022

(54) PLUG CONNECTOR AND PLUG CONNECTOR ARRANGEMENT HAVING A PLUG CONNECTOR OF THIS KIND

(71) Applicant: Robert Bosch GmbH, Stuttgart (DE)

(72) Inventors: Georg Wallensteiner, Gemmrigheim (DE); Long Dang Bao, Ho Chi Minh (VN); Markus Kroeckel, Schwieberdingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/761,407

(22) PCT Filed: Nov. 8, 2018

(86) PCT No.: PCT/EP2018/080533
§ 371 (c)(1),
(2) Date: May 4, 2020

(87) PCT Pub. No.: WO2019/105705
PCT Pub. Date: Jun. 6, 2019

(65) Prior Publication Data

US 2021/0006000 A1 Jan. 7, 2021

(30) Foreign Application Priority Data

Nov. 30, 2017 (DE) ..... 102017221521.6

(51) Int. Cl.
*H01R 13/514* (2006.01)
*H01R 13/436* (2006.01)
(Continued)

(52) U.S. Cl.
CPC ..... *H01R 13/4362* (2013.01); *H01R 13/502* (2013.01); *H01R 13/5227* (2013.01);
(Continued)

(58) Field of Classification Search
CPC ..... H01R 13/4362; H01R 13/502; H01R 13/5227; H01R 13/62933; H01R 13/6597;
(Continued)

(56) References Cited

U.S. PATENT DOCUMENTS 4,534,609 A 8/1985 White
4,867,711 A 9/1989 Yuasa
(Continued)

FOREIGN PATENT DOCUMENTS

CN 107134670 A 9/2017
DE 102014216281 A1 2/2016
(Continued)

OTHER PUBLICATIONS

International Search Report for PCT/EP2018/080533, dated Feb. 12, 2019.

*Primary Examiner* — Thanh Tam T Le
(74) *Attorney, Agent, or Firm* — Norton Rose Fulbright US LLP; Gerard Messina

(57) ABSTRACT

A plug connector for plugging onto or into a counterpart plug connector, having at least two counterpart contact elements, in a plugging direction. The plug connector has a housing having a first plane that faces in the plugging direction. The housing has at least two contact chambers, each of which has an opening in the first plane. At least two of the contact chambers in the housing are embodied separately from one another. A wall, which protrudes from the first plane when viewed oppositely from the plugging direction, is disposed between at least two mutually adjacent contact chambers. Alternatively or additionally, at least one groove is disposed in the first plane between at least two mutually adjacent contact chambers.

17 Claims, 10 Drawing Sheets

(51) Int. Cl.
*H01R 13/502* (2006.01)
*H01R 13/52* (2006.01)
*H01R 13/629* (2006.01)
*H01R 13/6597* (2011.01)
*H01R 13/707* (2006.01)

(52) U.S. Cl.
CPC ... *H01R 13/62933* (2013.01); *H01R 13/6597* (2013.01); *H01R 13/707* (2013.01)

(58) Field of Classification Search
CPC ..... H01R 13/707; H01R 13/447; H01R 13/6275; H01R 13/4223; H01R 13/514
USPC .... 439/136, 145, 147, 345, 595, 752, 752.5, 439/701
See application file for complete search history.

(56) References Cited

U.S. PATENT DOCUMENTS 5,002,504 A * 3/1991 Carlson ..... H01R 13/506 439/595
5,017,163 A * 5/1991 Ohsumi ..... H01R 13/4362 439/752
5,037,336 A * 8/1991 Betsui ..... H01R 13/4368 439/752
5,123,866 A * 6/1992 Endo ..... H01R 13/4368 439/595
5,292,261 A * 3/1994 Hirano ..... H01R 13/4368 439/595
5,358,427 A * 10/1994 Miwa ..... H01R 13/4362 439/595
5,458,511 A * 10/1995 Sasai ..... H01R 13/4368 403/326
5,490,802 A * 2/1996 Plyler ..... H01R 13/4368 439/752
5,607,327 A * 3/1997 Tsuji ..... H01R 13/4365 439/595
5,653,613 A * 8/1997 Shimoda ..... H01R 13/4361 439/752
5,839,923 A * 11/1998 Yoshida ..... H01R 13/4362 439/752
5,997,318 A * 12/1999 Chou ..... H01R 13/5213 439/136
6,305,956 B1 * 10/2001 Deng ..... H01R 13/4532 174/67
6,406,608 B1 * 6/2002 Uzoh ..... C25D 21/14 204/237
6,596,940 B2 * 7/2003 Wang ..... H01R 13/4534 174/67
6,602,081 B1 * 8/2003 Wang ..... H01R 13/4534 439/137
6,695,622 B2 * 2/2004 Korsunsky ..... H01R 31/06 439/631
6,994,598 B2 * 2/2006 Holmes ..... H01R 13/4361 439/752
7,261,603 B2 * 8/2007 Takahashi ..... H01R 13/4361 439/595
7,402,087 B2 * 7/2008 Wang ..... H01R 13/113 439/382
8,096,841 B2 * 1/2012 Hirano ..... H01R 13/4361 439/752
8,727,816 B2 * 5/2014 Takahashi ..... H01R 13/4361 439/752
9,039,458 B2 * 5/2015 Tsuchiya ..... H01R 13/4365 439/686
9,039,462 B2 * 5/2015 Yoon ..... H01M 8/2465 439/752
2015/0325948 A1 11/2015 Kurita

FOREIGN PATENT DOCUMENTS

DE 102015203489 A1 9/2016
EP 1450446 A2 8/2004
EP 2390959 A1 11/2011
FR 2821493 A1 8/2002
GB 2218272 A 11/1989
JP H07118344 B2 12/1995
JP 2017073291 A 4/2017

* cited by examiner

PLUG CONNECTOR AND PLUG CONNECTOR ARRANGEMENT HAVING A PLUG CONNECTOR OF THIS KIND

FIELD

The present invention relates to an electrical plug connector for plugging onto or into a counterpart plug connector, and to a plug connector assemblage having a plug connector of that kind.

BACKGROUND INFORMATION

The related art includes electrical plug connectors for plugging onto or into a counterpart plug connector.

When such plug connectors are used in high-current applications, the plug connector usually has at least two contact elements that are brought mechanically and electrically into contact with two counterpart contact elements on the counterpart plug connector. The counterpart contact elements can be embodied, for example, as contact blades or contact pins. The system made up of a plug connector and counterpart plug connector can be referred to as a "plug connector assemblage."

It is important, specifically for the high currents that are transferred in the context of high-current applications between the plug connector and counterpart plug connector in such plug connector assemblages, for the contact elements (called "power terminals") and counterpart contact elements (called "power pins") through which the high currents are directed to be permanently insulated from one another. A short circuit between adjacent contact elements when a voltage is applied is absolutely to be avoided, since damage to the plug connector assemblage can occur as a result of the high currents in the event of a short circuit. A short circuit of this kind can be triggered, for example, by infiltrating liquid, for instance water or very generally an electrically conductive fluid medium. Loose contact elements that are not properly secured in the pertinent contact chambers can also represent a risk of causing a short circuit.

In order to avoid short circuits due to water or very generally an electrically conductive fluid medium, it is possible to provide seals that preclude the infiltration of water into the plug connector assemblage. For example, single-wire seals or sealing mats can be provided, or radial seals between the plug connector and the counterpart plug connector. The plug connector can be embodied, for instance, as a "female" type, and the counterpart plug connector as a "male" type.

German Patent Application No. DE 10 2014 216 281 A1 describes a plug connector assemblage for high-current applications in which a radial seal between the plug connector and the counterpart plug connector is said to prevent the infiltration of water.

SUMMARY

The present invention proceeds from the recognition that infiltration of water, or very generally of an electrically conductive fluid medium, into the plug connector assemblage can occur despite good sealing using sealing elements. For example, the seals can age or a seal can be damaged.

Since loose contact elements that are not properly secured in the relevant contact chambers can also represent a risk of causing a short circuit, it can be necessary to lock the contact elements in the contact chambers by way of a contact locking element that is displaceable, for instance, transversely to a plugging direction, i.e., to secure them against unintended release from the contact chamber, for instance oppositely to the plugging direction.

For example, at the currents used, which are more than 10 A, more than 50 A, more than 100 A, or even more than 400 A, and/or at voltages of more than 48 V, more than 450 V, or even more than 1000 V, short circuits can be a large risk to the plug connector assemblage, for instance due to the heat evolution occurring in that context. This applies even in a context of large conductor cross sections, which can be equal to more than 1 square millimeter ($mm^2$), more than 5 $mm^2$, or more than 16 $mm^2$ or even more than 100 $mm^2$.

A need can therefore exist for furnishing a plug connector that on the one hand has a contact locking system in order to secure the high-current-carrying contact elements reliably in their contact chambers, and is configured to prevent infiltrating water, or very generally an infiltrating electrically conductive fluid medium, from forming a short-circuit path between the contact elements or in the plug connector assemblage between the counterpart contact elements. The intention is in particular to preclude a short-circuit path between mutually adjacent contact elements, since a particularly short water segment is sufficient here to generate a short circuit.

This need can be met by example embodiments of the present invention. Advantageous embodiments of the present invention are described herein.

In the context of the Application, the terms "encompass" and "have" are used synonymously unless explicitly mentioned otherwise.

The plug connector is an electrical plug connector that is embodied in particular at least partly for the transfer of high currents.

According to a first aspect of the present invention, an example plug connector for plugging onto or into a counterpart plug connector in a plugging direction is provided, the counterpart plug connector having at least two counterpart contact elements.

The plug connector has a housing having a first plane that faces in the plugging direction. The housing has at least two contact chambers, each of which has an opening in the first plane. Each contact chamber is configured to receive one contact element that is configured for electrical and mechanical contacting of one of the at least two counterpart contact elements of the counterpart plug connector. A contact locking element is disposed on the first plane for locking the contact elements that are introducible into the contact chambers. At least two of the contact chambers in the housing are embodied separately from one another. Provision is made that a wall, which protrudes from the first plane when viewed oppositely from the plugging direction, is disposed between at least two mutually adjacent contact chambers.

Alternatively or additionally, at least one groove is disposed in the first plane between at least two mutually adjacent contact chambers.

In other words, the wall and/or the at least one groove are disposed in the first plane between the openings that belong to the adjacent contact chambers. The adjacent contact chambers can be directly adjacent contact chambers.

The advantageous result thereof is that on the one hand, secure locking by the contact locking elements of contact elements introducible into the contact chamber can be ensured. At the same time, it becomes considerably more difficult or entirely impossible for a liquid, for instance water, which might travel as far as the first plane to form a short-circuit path along the first plane. This is because the wall and/or the at least one groove redirects the water in channel-like fashion and prevents the water from flowing directly from one opening or contact chamber to the adjacent opening or contact chamber. The water can thus be directed by the wall and/or the at least one groove to the edge of the first plane, where it can flow out. Alternatively, the water flows separately in each of the mutually separated contact chambers, so that a short circuit between the contact elements, in particular on the first plane, is thereby also prevented.

If a large quantity of water happens to infiltrate, formation of the short-circuit path along the first plane is at least delayed by the wall and/or the at least one groove, since the water cannot flow directly along the shortest path between the contact chambers. In this case, for instance, a sensor additionally disposed in the plug connector or in a plug connector assemblage encompassing the plug connector can detect the infiltrating water. The current of the high-current connection can thereupon be interrupted before a short circuit of the contact elements occurs. A sensor of this kind, e.g., a water sensor, embodied e.g., as a resistance sensor, can be disposed, for instance, in at least one of the contact chambers or in the vicinity of one of the contact chambers. Upon detection of a defined moisture level or of standing water, the sensor can, for instance, transmit a signal to a control system which then interrupts the flow of current to the contact elements.

The wall and/or the at least one groove is advantageously embodied in such a way that it prevents the flow of water on the shortest path between adjacent contact chambers in all installation positions, i.e., for example, in an installation position in which the plugging direction points in the direction of gravity, or in which the plugging direction points in a direction perpendicular to the insertion direction, or at all angles between those two positions. Even with a plugging direction that is pivoted more than 90° with respect to the direction of gravity, the wall and/or the at least one groove can contribute, as a kind of shield or adhesion block or flow block, to connecting infiltrated water directly on the shortest path between adjacent contact chambers or also contact chambers that are farther from one another.

The first plane can be embodied in such a way that there exists along the first plane a path that connects at least two of the contact chambers, or the openings thereof, to one another. In other words, the housing cannot be regarded as a block having contact chambers separate from one another, only one notional or virtual plane then being located in the block.

The contact chambers can be embodied to be completely separate from one another within the housing, i.e., below the openings in the first plane. They can thus each individually constitute a separate contact chamber. They are accordingly spaced apart from one another in a direction perpendicular to the plugging direction. This also applies to the openings belonging to the contact chambers.

Provision can be made that a respective wall is provided on the first plane between all mutually adjacent contact chambers, and/or at least one groove is provided in the first plane. These walls and grooves can be embodied in such a way that they do not interfere with displacement of the contact locking element.

It is understood that, generally, a flash formed in the context of an injection molding process is not to be regarded as a "wall" for purposes of the present invention.

The contact chambers can be disposed, for example, in a row in a direction perpendicular to the plugging direction. If more than two, or even more than three, contact chambers are present, the contact chambers can then also be embodied in a kind of matrix disposition in the housing, i.e., in rows and columns each perpendicular to the plugging direction.

The contact locking element can be, for example, a single contact locking element. In other words, only a single contact locking element is provided in the plug connector. With it, for example, all the contact elements introducible into the contact chambers can be secured simultaneously. The installation process is thereby advantageously simplified.

The contact element can be, for instance, displaceable along the first plane and can either completely expose or at least partly cover the openings of the contact chambers. For that purpose, the contact locking element can be, for example, displaceable or shiftable along the first plane in an insertion direction perpendicular to the plugging direction.

The counterpart plug connector has at least two counterpart contact elements that can be embodied, for instance, as contact blades or contact pins and are embodied, for instance, to transfer high currents of at least 10 A or at least 50 A, in particular at voltages of at least 12 V or at least 45 V or at least 100 V. The counterpart contact elements can have for that purpose, for instance, a cross section or contact area for the corresponding contact element of at least 2 $mm^2$ or at least 5 $mm^2$ or at least 10 $mm^2$ or at least 20 $mm^2$ or at least 50 $mm^2$, for example 6 $mm^2$ or 50 $mm^2$ or 90 $mm^2$.

The contact elements are correspondingly also embodied to conduct the high currents. For example, the contact elements are embodied to be plugged onto the counterpart contact elements.

The plug connectors or the contact elements can be embodied, for instance, as "female" type plug elements, and the counterpart plug connectors or counterpart contact elements as "male" type.

The fact that, in the case in which a wall is provided on the first plane between adjacent contact chambers, the wall projects beyond the first plane by at least 0.25 mm or at least 0.5 mm or at least 1 mm or at least 1.5 mm or at least 2 mm, advantageously ensures that infiltrating water cannot create the shortest short-circuit path between adjacent contact chambers.

The wall can have a width that is equal, for instance, to at least 0.25 mm or at least 0.5 mm or at least 1 mm or at least 1.5 mm or at least 2 mm.

Alternatively or additionally, provision can be made that in the case in which at least one groove is provided on or in the first plane, that at least one groove has a depth with respect to the first plane which is equal to at least 0.25 mm or at least 0.5 mm or at least 1 mm or at least 1.5 mm or at least 2 mm. The result is that, advantageously, a particularly effective runoff for the water is produced in the nature of a channel, or a particularly effective flow block is formed.

The at least one groove can have a groove width that, for instance, is equal to at least 0.25 mm or at least 0.5 mm or at least 1 mm or at least 1.5 mm or at least 2 mm.

In a refinement of the present invention, provision is made that a contact element is disposed in at least two of the at least two contact chambers.

The wall and/or the at least one groove thus advantageously precludes a short circuit between two contact elements due to infiltrating water.

If only two contact chambers are provided, both contact chambers are accordingly populated with contact elements. With more than two contact chambers, however, it can happen that the plug connector is used for a modular system and, depending on the application, only exactly two, more than two, or even all contact chambers are populated with contact elements. In the case in which not all contact chambers are populated, the wall and/or the at least one groove is embodied at least between the closest adjacent occupied contact chambers.

The advantageous result of the fact that the at least two contact chambers are embodied as a passthrough opening through the housing, when viewed in the plugging direction, is that water infiltrating as far as the first plane can flow out through the passthrough opening and leave the housing and thus the first plane.

The advantageous result of the fact that the wall extends at least along an overlap length of the lengths of the adjacent openings is that there exists, along an overlap region of a projection of the openings in a direction perpendicular to the plugging direction, no direct connecting path in the projection direction between the openings and thus between the contact chambers. The projection direction can extend, for instance, along the shortest connecting distance between the adjacent contact chambers or their openings. Infiltrating water is thus reliably prevented from flowing from one contact chamber into the adjacent contact chamber, and a short short-circuit path is thus also precluded. Particularly advantageously, the wall extends uninterruptedly at least along the projection length.

A refinement according to the present invention provides that the housing has an outer rim that surrounds the first plane and projects beyond the first plane oppositely to the plugging direction. The rim surrounds the first plane over a circumferential angle of at least 220° around the plugging direction. The wall and/or the at least one groove is guided through the rim in a radial direction perpendicular to the plugging direction. A respective cutout is provided in a circumferential direction on either side of the wall between the rim and the wall. In other words, outflow openings are provided between the wall and the rim. The advantageous result is that water that has been guided through the wall and/or the at least one groove as far as the rim, i.e., to the edge of the first plane, can flow off the first plane through the cutouts and, for example, run off along an outer side of the housing. Accumulation of water within the rim is thus advantageously avoided.

The rim can project beyond the first plane, i.e., project outward from the first plane oppositely to the plugging direction, for instance, by at least 0.25 mm or at least 0.5 mm or at least 1 mm or at least 1.5 mm or at least 2 mm.

It is understood that without a rim, water can readily flow off on an outer side of the housing after passing over the edge of the first plane.

A refinement of the present invention provides that the two cutouts extend, when viewed in the plugging direction, at least from the first plane of the housing to a second plane, facing away from the first plane, of the housing. In other words, the cutouts are each embodied as a kind of groove on an outer side of the housing, between the first plane and the second plane. They thus function advantageously as a kind of "rain gutter" or defined flow path or flow aid for liquid, e.g., water, along the outer side of the housing. For example, a sensor for detecting liquid, e.g., water, can be disposed on the second plane in the region of the cutouts, which sensor, if applicable, interrupts the flow when liquid is identified. The result of the configuration of the cutouts is that the liquid can be deliberately directed to such a sensor.

The advantageous result of the fact that the contact locking element is displaceable on the first plane perpendicularly to the plugging direction from a first position into a second position, such that when the contact locking element is in the second position, the contact elements are prevented by the contact locking element from being removed from the contact chambers oppositely to the plugging direction, is that a short circuit between contact elements during operation is prevented. Detachment of a contact element from the pertinent contacted counterpart contact element during operation is also prevented. In a context of transmission of high currents, in such a case there could, for instance, be undesired damage to a contact element and/or counterpart contact element, for instance due to an arc.

When the contact locking element is in the first position, the contact elements can be introducible into and removable from the contact chambers.

In accordance with the present invention, provision can be made that the contact locking element is movable repeatedly back and forth between the first and the second position, for instance for installation purposes and/or removal purposes.

A refinement of the present invention provides that the contact locking element has a latching apparatus. The wall and/or the at least one groove has, on an end face that faces in a direction opposite to the plugging direction, a structure which is complementary to the latching apparatus and into which the latching apparatus can latch. The advantageous result thereof is that upon installation, it is possible to determine by way of a haptic signal (latching) whether and that the contact locking element (contact lock) has been moved into the first or the second position. At the same time the first or the second position of the contact locking element is thereby secured against inadvertent displacement.

An assemblage on the end face of the wall has the further advantageous result that a flow of liquid along the first plane is not impaired by the latching apparatus, or that the flow is not diverted.

A refinement of the present invention provides that the contact locking element has two arms that protrude from a base element and are at a distance from one another, perpendicularly to their direction of extent, which is greater than a width of the wall transversely to the plugging direction. The two arms proceed on either side of the wall when the contact locking element is in the inserted state.

The distance between the arms can be, for instance, at most 1 mm greater or at most 0.2 mm greater than the width of the wall.

The advantageous result is that the wall also has, in addition to its separating function for the liquid, a guidance function for the contact locking element. Correct insertion of the contact locking element is thereby promoted, and thus also secure and reliable locking of the contact elements populating the contact chambers. The result of the wall is thus that the plug connector is particularly well protected against short circuits, on the one hand by the contact locking element against inadvertent detachment, and on the other hand against a short-circuit path due to infiltrating water.

A projection that protrudes from the arms transversely to a direction of extent of the arms can be disposed on the arms, for instance in the vicinity of the base element. The result that can thereby be obtained is that when the contact locking element is in the first position, the projection does not cover the corresponding opening, and in the second position it at least partly covers the opening. The projection can thereby represent a kind of undercut that prevents the contact element from moving out oppositely to the plugging direction.

It is understood that one arm or two arms can be provided on the contact locking element for several openings or for each opening, i.e., for several contact chambers or for each contact chamber. Those arms can all be disposed on the base element.

The contact locking element can also be embodied differently, i.e., configured without linear arms.

Lastly, the wall and the two arms create a kind of poka-yoke solution that prevents the insertion of an incorrect contact locking element into the plug connector. This is important in the context of installation, to ensure that a plug connector constructed from several individual parts is correctly assembled and can perform its function, i.e., in this case, for instance, to secure the contact elements inserted into the contact chambers.

A refinement of the present invention provides that the latching apparatus is connected to the two arms proceeding on either side of the wall. The latching apparatus connects the two arms at their free ends by way of a connecting element. The connecting element spans the wall, viewed oppositely to the insertion direction. The advantageous result thereof is on the one hand that the latching apparatus is stabilized and is embodied robustly in terms of mechanical loads. At the same time, the two mutually connected arms are stabilized. They can better withstand damage resulting, for instance, from skewed insertion of the contact locking element. The above-described poka-yoke solution is thereby further improved. In addition, slippage of the latching apparatus away from the end face of the wall is prevented.

If more than one wall is provided, it can be sufficient to provide a latching apparatus only on one wall on the end face. Several latching apparatuses are, however, also then conceivable.

According to a second aspect of the present invention, an electrical plug connector assemblage is proposed.

The electrical plug connector assemblage has:

a plug connector as described above;

a counterpart plug connector having at least two counterpart contact elements.

The plug connector is plug-assembled and electrically contacted to the counterpart plug connector in a plugging direction.

The counterpart contact elements can be embodied, for instance, as contact blades or contact pins. Contact surfaces (called "lands") on a circuit board are also possible.

In accordance with the present invention, the example plug connector assemblage is advantageously notable for particularly good reliability with respect to short circuits, by the fact that detachment of contact elements from the contact chambers is prevented by way of the, preferably single, contact locking element. At the same time, a short circuit resulting from water infiltrating into the plug connector assemblage is avoided by prevention of a short short-circuit path between adjacent contact chambers and/or contact elements.

BRIEF DESCRIPTION OF THE DRAWINGS

Further features and advantages of the present invention will be evident to one skilled in the art from the description below of exemplifying embodiments, which are nevertheless not to be construed as limiting the present invention, and with reference to the figures.

DETAILED DESCRIPTION OF EXAMPLE EMBODIMENTS

Figure 1A:
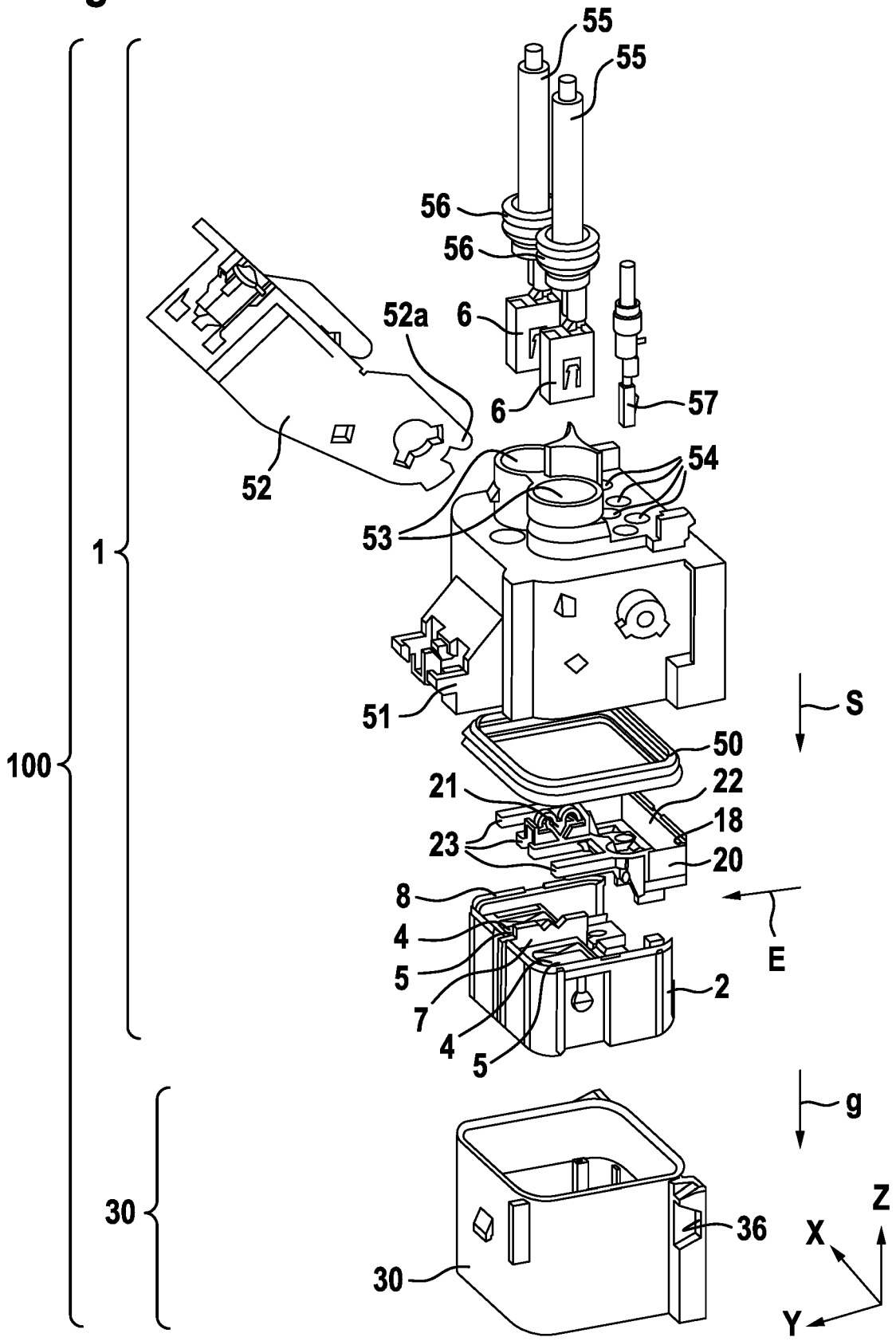
FIG. 1*a* is an exploded perspective view of an example plug connector assemblage in accordance with the present invention.

FIG. 1*a* is an exploded perspective view of a plug connector assemblage 100 in accordance with an example embodiment of the present invention. Plug connector assemblage 100 has a plug connector 1; and a counterpart plug connector 30 having at least two counterpart contact elements (31, see FIG. 1*c*), plug connector 1 being plug-assembled and electrically contactable to counterpart plug connector 30 in a plugging direction S. In the depiction, plugging direction S corresponds to direction of gravity g.

Plug connector 1 is configured to be plugged onto or into counterpart plug connector 30 in plugging direction S. Plug connector 1 has a housing 2 having a first plane 3 that faces in plugging direction S. First plane 3 has substantially the shape of a rectangle having rounded edges.

A Cartesian coordinate system having X, Y, and Z axes is shown in this Figure and the following Figures for better orientation. Plugging direction S extends oppositely to the Z direction of the coordinate system. With the orientation of the coordinate system as depicted relative to plug connector assemblage 100, in particular relative to first plane 3 of housing 2, the X direction can also be referred to as a width direction and the Y direction as a longitudinal direction.

An external housing 51 is installed above housing 2, a radial seal 50 (merely by way of example) being installed between housing 2 and external housing 51 and being intended to prevent infiltration of water, or very generally of an electrically conductive fluid medium, from an external region of plug connector 1 onto first plane 3.

A lever 52, which can engage by way of tooth elements 52*a* into a toothed rack 36 on counterpart plug connector 30 upon plug-assembly of plug connector 1 and counterpart plug connector 30, can be disposed on external housing 51 so that plug connector 1 can be pulled onto counterpart plug connector 30 by pivoting lever 51.

Housing 2 has at least two contact chambers 4, each of which has an opening 5 in first plane 3. In the exemplifying embodiment depicted, exactly two contact chambers 4 are provided. Each contact chamber 4 is configured to receive one contact element 6. Each contact element 6 is configured for electrical and mechanical contacting of one of the at least two counterpart contact elements 31 of counterpart plug connector 30. Each contact element 6 is electrically and mechanically connected to a lead 55 that has an insulator around an electrically conductive core (a wire or a strand bundle). A single-wire seal 56 having several sealing blades spaced apart from one another along a direction of extent of the lead can be provided on each lead 55.

A contact locking element 20 is disposed on first plane 3 in order to lock contact elements 6 that are introducible into contact chambers 4. Contact locking element 20 is slidable or displaceable into plug connector 1 from the side in an insertion direction E, i.e., transversely to plugging direction S. This means that it can be displaced, transversely to plugging direction S, over or on first plane 3. It has on one side, perpendicularly to insertion direction E, a contact locking element skirt 18 that, when contact locking element 20 is in the inserted state, extends beyond first plane 3 oppositely to plugging direction S.

In this exemplifying embodiment housing 2 has, merely by way of example, an external rim 8 that surrounds or delimits first plane 3 and projects beyond first plane 3 oppositely to plugging direction S.

The two contact chambers 4 are embodied separately from one another in housing 2.

In the exemplifying embodiment depicted, a wall 7 that protrudes oppositely from plugging direction S when viewed from first plane 3 is disposed between the two mutually adjacent contact chambers 4. A direct connection between the two openings 5 along plane 3 is thereby precluded. As a result, liquid that might travel as far as plane 3 despite radial seal 50 and single-wire seals 56 cannot flow along the shortest path, or even only a short path, from the one opening 5 to the adjacent other opening 5, with the result that a short circuit between contact elements 6 or counterpart contact elements 31 is reliably prevented.

Alternatively or additionally, at least one groove, for example a respective groove on each side of wall 7, can be disposed in first plane 3 between the two mutually adjacent contact chambers 4. In the exemplifying embodiment depicted, these grooves are not shown. At least one groove can also be configured instead of wall 7. First plane 3 can then be embodied to be particularly flat, and contact locking element 20 can be moved in particularly unobstructed fashion over first plane 3.

Housing 2 here also additionally has signal contact openings 61 having signal contact chambers located therebelow. These signal contact chambers are configured to receive signal contacts 57 having leads disposed thereon.

Two insertion openings 53 for contact elements 6, as well as six signal contact insertion openings 54 for signal contacts 57, are provided in external housing 51 of the exemplifying embodiment.

Contact elements 6 are configured to transport currents of at least 10 A, preferably at least 20 A or at least 50 A, preferably at least 100 A. They can be dimensioned correspondingly and can have contact areas of, for instance, at least 2 $mm^2$ or at least 5 $mm^2$ or at least 10 $mm^2$, preferably at least 20 $mm^2$ with respect to the counterpart contact elements.

The signal contacts, conversely, can have, for example, smaller dimensions. Signal voltages, for instance 0 V to 5 V, are applied to them, and only small signal currents flow, for instance less than 3 A, preferably less than 1 A, and particularly preferably less than 300 mA. While a short circuit caused between them, for instance, due to liquid, for example water or urea solution or brake fluid, etc. is also not advantageous, the result is that substantially less power is transferred as compared with a short circuit between current-carrying contact elements 6.

Figure 1B:
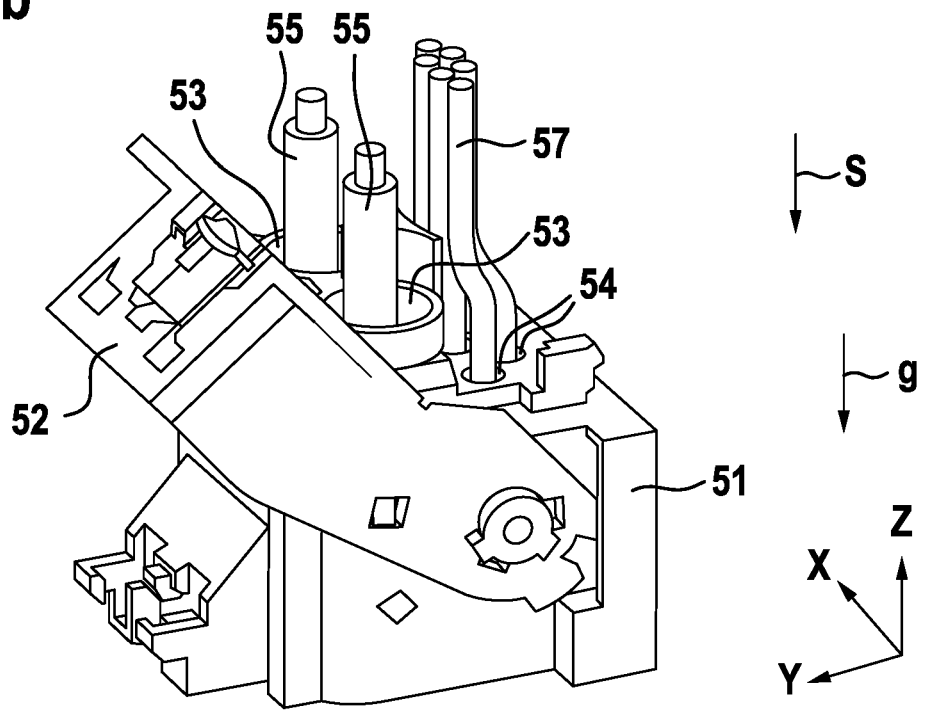
FIG. 1*b* shows the plug connector of the plug connector assemblage of FIG. 1*a* in the assembled state.

FIG. 1*b* shows plug connector 1 of FIG. 1*a* in an assembled state. Housing 2 is now disposed in the interior of external housing 51 and is not visible here. Plug connector 1 has two contact elements 4, the two leads 55 of which are evident, as well as six signal contact elements 57 with their leads.

Figure 1C:
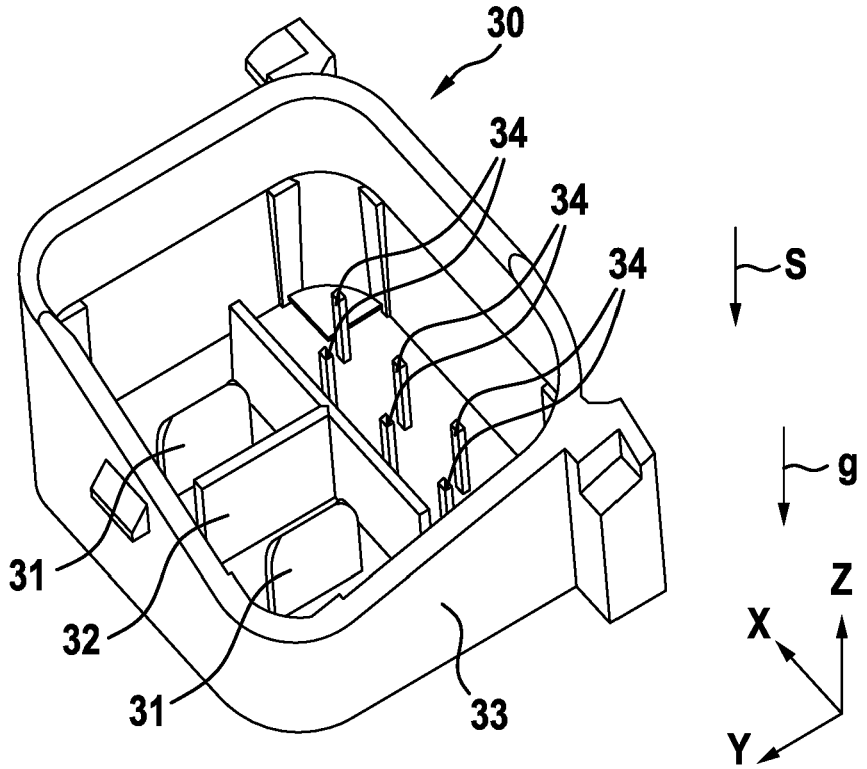
FIG. 1*c* shows the counterpart plug connector of FIG. 1*a*.

FIG. 1*c* is a perspective view, facing toward the viewer, of counterpart plug connector 30. The two counterpart contact elements, embodied as contact blades, are clearly evident. A contact guard 32 is disposed between the two counterpart contact elements 31. A matrix of six counterpart signal contact elements 34, which are embodied as pins, is physically separated from counterpart contact elements 31. Counterpart contact elements 31 embodied as contact blades can also be embodied, for instance, as pins or even as contact pads of a conductor path.

Figure 2:
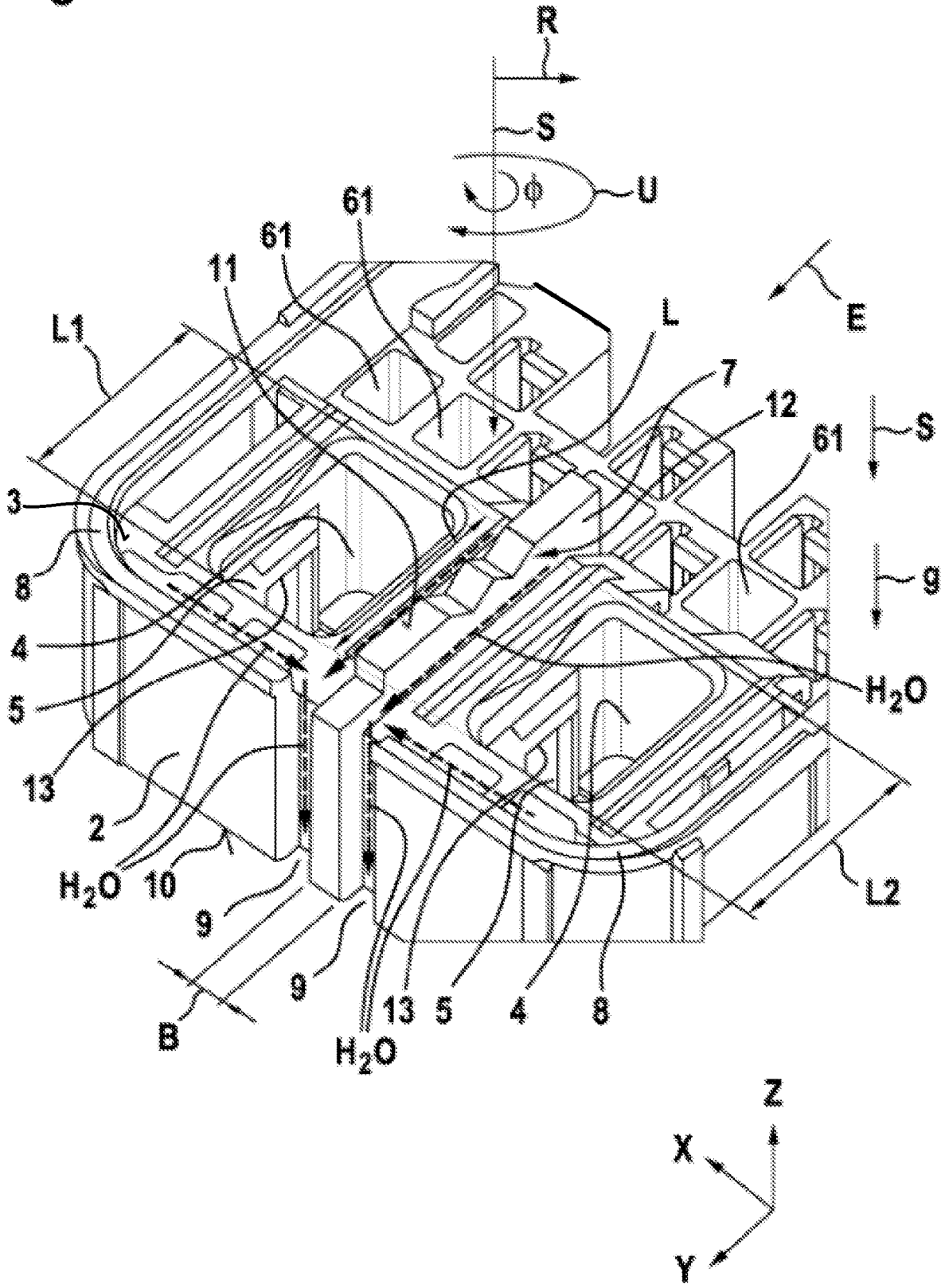
FIG. 2 shows a housing of the plug connector of FIG. 1*a*.

FIG. 2 shows housing 2 without the contact locking element, in more detail.

Wall 7 projects at least 0.25 mm or at least 0.5 mm or at least 1 mm or at least 1.5 mm or at least 2 mm beyond first plane 3. If, alternatively or additionally, at least one groove happens to be embodied between adjacent openings 5, that groove then has a depth with respect to first plane 3. That depth can be equal, for example, to at least 0.25 mm or at least 0.5 mm or at least 1 mm or at least 1.5 mm or at least 2 mm. A width B of wall 7 or a width of the groove can be equal, for example, to at least 0.25 mm or at least 0.5 mm or at least 1 mm or at least 1.5 mm or at least 2 mm.

Wall 7 can thus serve as a kind of directing element for liquid, and a groove, constituting a kind of trench or channel, can likewise serve as a directing element for liquid.

Housing 2 has exactly two contact chambers 4. More than two contact chambers 4 can also be provided, for instance at least three or at least four contact chambers 4, e.g., five, six, seven, eight, nine, ten, or 14 or 20 contact chambers 4. These contact chambers 4 can be disposed next to one another in width direction X constituting a row. Also possible, however, is a matrix disposition in which, for instance, several rows extending in width direction X are spaced apart from one another with respect to longitudinal direction Y.

It is also possible for one or several contact chambers 4 not to be populated, for instance in order to furnish a housing 2 that, for modular constructions, is populated, e.g., respectively with two, three, four, or five contact elements 4, in which the positions populated can nevertheless be different depending on the replaceable counterpart plug connector 30. Merely by way of example, six contact chambers 4 can then be provided, of which, however, merely by way of example, only two or three are populated with contact elements 6.

Contact chambers 4 disposed in housing 2 each have on their walls, merely by way of example, at least one undercut 13 at which a latching tip of a contact element 6 inserted into contact chamber 4 can primarily latch before contact element 6 becomes finally secured (and thus secondarily locked) in its position by way of contact locking element 20 (not depicted here).

In the exemplifying embodiment depicted, the two contact chambers 4 are each of approximately the same size, so that contact elements 6 can be produced as identical parts. Openings 5 disposed in first plane 3 here have an approximately rectangular cross section that has rounded corners. The longitudinal sides extend along a first length L1 at first opening 5 (left opening in the image) and along a second length L2 at second opening 5 (right opening in the image). The longitudinal sides extend approximately in longitudinal direction Y. If the two mutually facing longitudinal sides of the adjacent openings are projected in a direction R perpendicular to plugging direction S and perpendicular to the longitudinal side of openings 5 (shortest distance between the openings), the result is then an overlap length L. Wall 7 extends in longitudinal direction Y at least over that overlap length L between the two openings 5. It is apparent in FIG. 2 that the wall in fact projects beyond lengths L1, L2 of openings 5 on either side of opening 5. As a result, it is not readily possible for liquid that arrives at first plane 3 to travel from the one opening 5 to the other opening 5 along the shortest path. A short circuit is thereby avoided.

Rim 8 of first plane (surface) 3 can project, for instance, at least 0.25 mm or at least 0.5 mm or at least 1 mm or at least 1.5 mm or at least 2 mm beyond first plane 3. It can be embodied in such a way that in the Z direction it interacts, with its end face, with radial seal 50 of the plug connector and thus prevents infiltration of liquid onto first plane 3 (visible, e.g., in FIG. 4*c*).

Rim 8 encircles or surrounds first plane 3 over a circumferential angle ϕ (phi) of at least 220° around plugging direction S (to illustrate this, plugging direction S is shown doubled in FIG. 2). In the exemplifying embodiment depicted, with an approximately rectangular cross section for first plane 3, first plane 3 is bordered on three sides: it is completely bordered on its two shorter sides and on one of its longer sides (here, the longer side facing left) with the exception of an opening described below, or two cutouts 9. On that longitudinal side of the first plane (surface) which faces to the right rear in the Figure, no rim 8 is provided or it is provided only in portions. The result is therefore that contact locking element 20 is inserted from this side onto the plane, and that access is created for a movement of contact locking element 20 in insertion direction E. Rim 8 that is absent here from the housing is supplemented by contact locking element skirt 18 of contact locking element 20 (see FIGS. 1*a*, 3*a*-3*c*, 4*a*), so that when contact locking element 20 is inserted, first plane 3 is still completely surrounded by a rim 8, 18.

The advantage of this embodiment of the plug connector having housing 2 and external housing 51, as well as contact locking element 20 disposed therebetween on first plane 3, is that in this manner, a single contact locking element 20 is sufficient to lock all contact elements 4 in their contact chambers 6. In order nevertheless to ensure good protection from a short circuit resulting from liquid, e.g., water, that may have traveled as far as first plane 3, wall 7 is provided between the adjacent contact chambers 4. Alternatively or additionally, at least one groove, which proceeds like a trench between openings 5 and can discharge water, can also be provided.

The two cutouts 9 extend, viewed along plugging direction S, at least from first plane 3 of housing 2 as far as second plane 10, facing away from first plane 3, of housing 1. This ensures that a short circuit between contact elements 6 due to a liquid path is precluded or delayed even when water is flowing off through both cutouts 9 on either side of wall 7. This is because the two cutouts 9 also proceed separately from one another on the outer surface of housing 2.

In the exemplifying embodiment depicted, wall 7 is guided through rim 8 in longitudinal direction Y, i.e., in a radial direction R perpendicular to plugging direction S. One cutout 9 is provided in a circumferential direction U respectively on either side of wall 7 between rim 8 and wall 7.

This ensures that even in the context of a plug connector assemblage 100 tilted toward the front left, liquid can flow off from first plane 3 through cutouts 9 and cannot rise to the height of rim 8 and then thereby surmount wall 7.

Contact chambers 4 have no connection inside housing 2. They are embodied here, by way of example, as passthrough openings through housing 2, and terminate in a second plane 10 at the lower (in the Figure) end of housing 2. There counterpart contact elements 31 can then enter into contact chambers 4 upon plug-assembly of plug connector 1 with counterpart plug connector 30.

Openings 5 of contact chambers 4 in first plane 3 are thus spaced apart from one another, but are connectable to one another by a path in first plane 3. One such path proceeds, for instance, from left opening 5 along wall 7 toward the rear, to signal contact openings 61 where contact locking element 20 can be mounted, around wall 7, and to right-hand opening 5. This path is, however, considerably longer than the shortest path, which would proceed transversely through wall 7. A path of this kind which is prolonged by wall 7 furthermore requires that the liquid firstly flow in one direction (for instance, in the case of a slight rearward tilt, in the direction of gravity g) and would then, after going around wall 7, need to flow oppositely to that direction, i.e., then oppositely to gravity g. Alternatively, the tilt, for instance to the left, would need to be so great that the liquid exceeds the height of wall 7 (or, alternatively, a trench depth of a groove) before it flows out over first plane 3 and then flows off along the outer wall of housing 2. Wall 7 thus makes it more probable that, for example in the context of a forward tilt, the liquid will flow along wall 7 as indicated by the arrows and flow off from first plane 3 at cutouts 9, and will not in fact go around wall 7 and flow back upward on the other side of wall 7.

For the case in which liquid can gain access to first plane 3, that liquid can flow off not only on the outer side of first plane 3 but also through contact chambers 4 themselves. In order to prevent a short circuit in a context of current flow at second plane 10, at least one sensor can additionally be disposed, for instance, in the vicinity of second plane 10 and/or in at least one contact chamber 4, that sensor being configured to detect liquid or moisture or a liquid level. If liquid or moisture or a liquid level is detected by the sensor, the current can be shut off so that a short circuit between two or more contact elements 6 or counterpart contact elements 31 by way of the liquid cannot cause any damage. Wall 7 (and/or the at least one groove) brings about at least a delay in the short circuit, so that the current can be shut off promptly by way of the sensor in the event of a liquid intrusion.

Figure 3A:
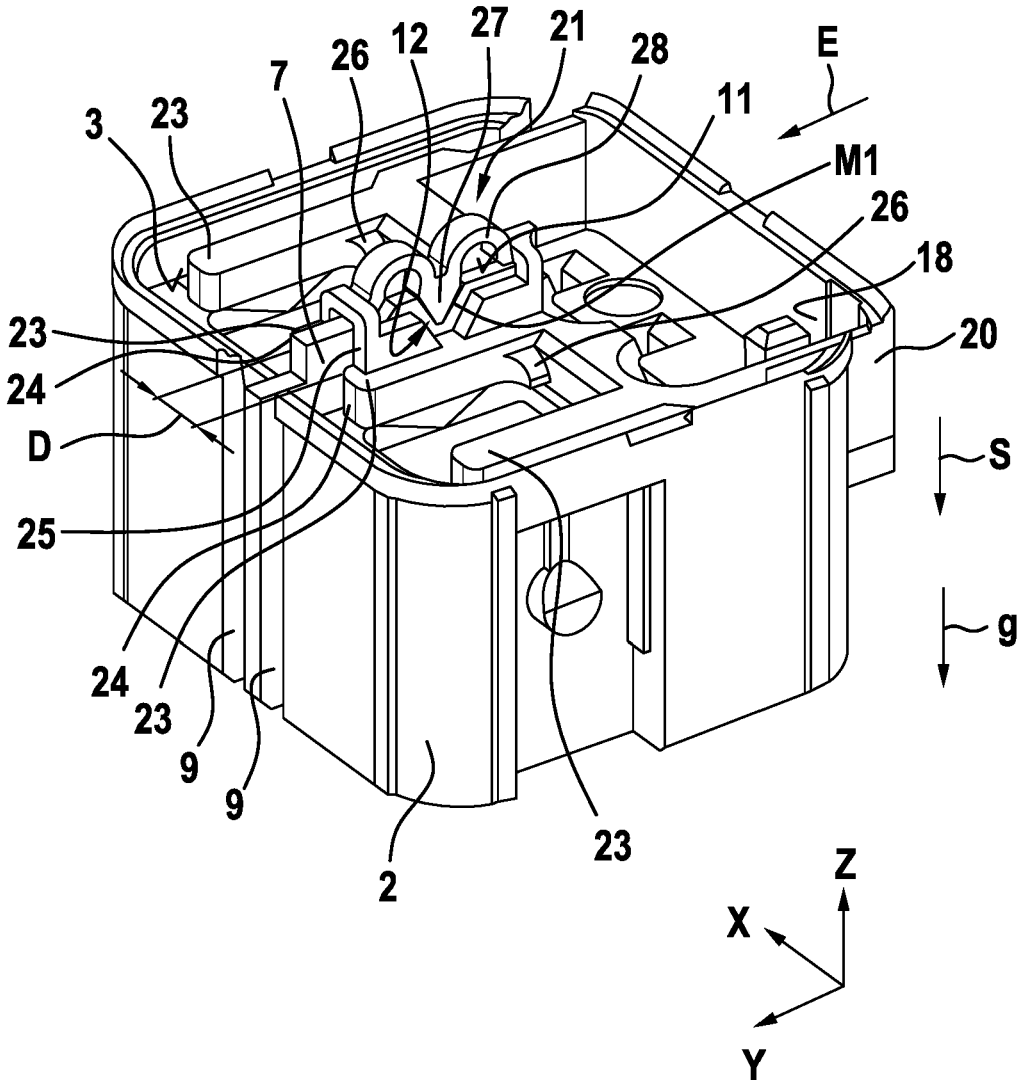
FIG. 3*a* shows the housing of the plug connector of FIG. 2 with a contact locking element.

FIG. 3*a* shows housing 2 of the plug connector of FIG. 2 with a contact locking element 20.

Contact locking element 20 is embodied here in one piece. Only a single contact locking element 20 is provided in plug connector 1. Contact locking element 20 has two arms 23 protruding from a base element 22. Base element 22 here extends, merely by way of example, in width direction X. Arms 23 protrude approximately perpendicularly from base element 22, and extend in insertion direction E as far as a free end 24. Arms 23 are embodied to be approximately straight or linear, resulting in a comb-like structure for contact locking element 20. Arms 23 adjacent to wall 7 are at a distance D from one another perpendicularly to their direction of extent, that distance being greater than width B of wall 7 transversely to plugging direction S. The two arms 23 adjacent to wall 7 proceed on either side of wall 7 when contact locking element 20 is in the inserted state. Distance D can be, for example, at most 1 mm greater or at most 0.2 mm greater than width B of wall 7.

Contact locking element 20 is displaceable on first plane 3, in insertion direction E perpendicular to plugging direction S, from a first position into a second position.

In the first position, arms 23, with their projections 26, cover openings 5 not at all or only to the extent that, with contact locking element 20 in the first position, contact chambers 4 can be populated with contact elements 6. With contact locking element 20 in the second position, projections 26 on arms 23 partly cover openings 5 of contact chambers 4 at least in such a way that contact elements 6 that are inserted into contact chambers 4 are secured against being removed from contact chambers 4 oppositely to plugging direction S.

Contact locking element 20 has a latching apparatus 21, wall 7 (alternatively or additionally, the at least one groove) having, on an end face 11 that faces in a direction opposite to plugging direction S, a structure 12 which is complementary to latching apparatus 21 and into which latching apparatus 21 can latch. Latching apparatus 21 is embodied here as a kind of tip 27 on a spring structure 28, tip 27 being pressed by spring structure 28 onto end face 11 of wall 7. End face 11 has, in longitudinal direction Y, a topography having two adjacent local minima M1, M2 (only first minimum M1 is visible). When contact locking element 20 is then displaced in insertion direction E on first plane 3, tip 27 then slides along end face 11. When it reaches the first, e.g., wedge-shaped, minimum M1, tip 27 then latches in; here, for instance, the first position has been reached, and an installer receives a haptic feedback that, for example, a populating position (first position) has been reached. Contact locking element 20 can then be moved farther in insertion direction E only by an elevated expenditure of energy. If this happens, tip 27 then departs from first minimum M1 along an exit bevel 29 of first minimum M1 and, upon further movement, latches into a second, e.g., wedge-shaped, minimum M2. The installer receives the haptic feedback that, for instance, a locking position (second position) has been reached.

Latching apparatus 21 is connected, merely by way of example, to the two arms 23 proceeding on either side of wall 7. Latching apparatus 21 connects the two arms 23 adjacent to wall 7 at their free ends 24 by way of a connecting element 25, connecting element 25 spanning wall 7 when viewed oppositely to insertion direction S. The advantageous result thereof is on the one hand that the two arms 23 become mechanically stabilized. A further advantageous result is that latching apparatus 21 always slides with its tip 27 on end face 11 and its structure 12 complementary to latching apparatus 21, and cannot slide off laterally.

Figure 3B:
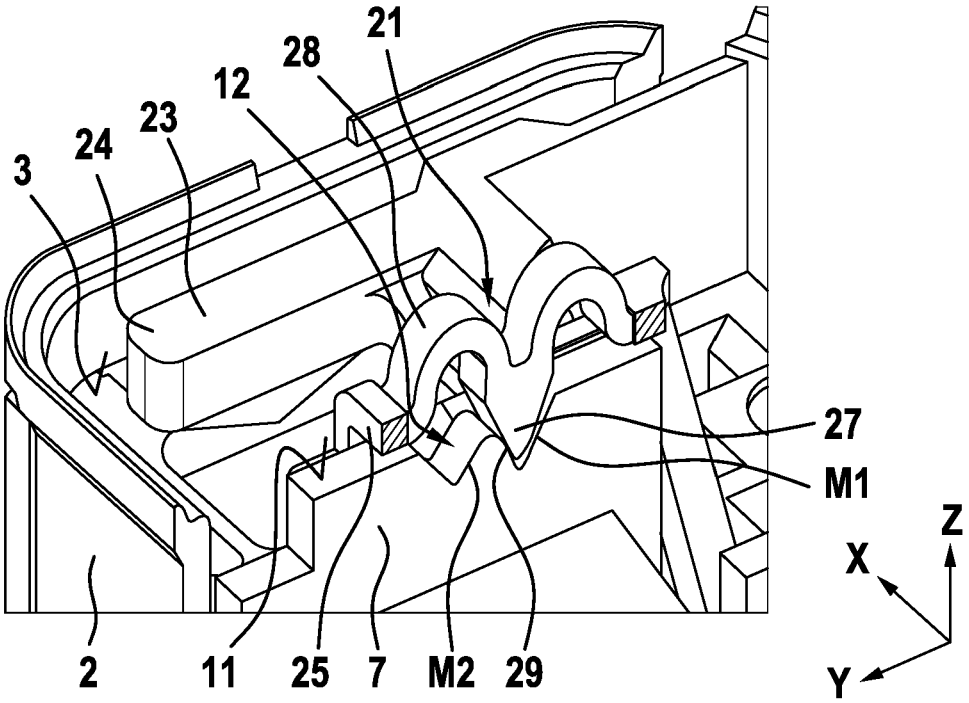
FIGS. 3*b* and 3*c* are detail views of the example contact locking element in two different positions.
Figure 3C:
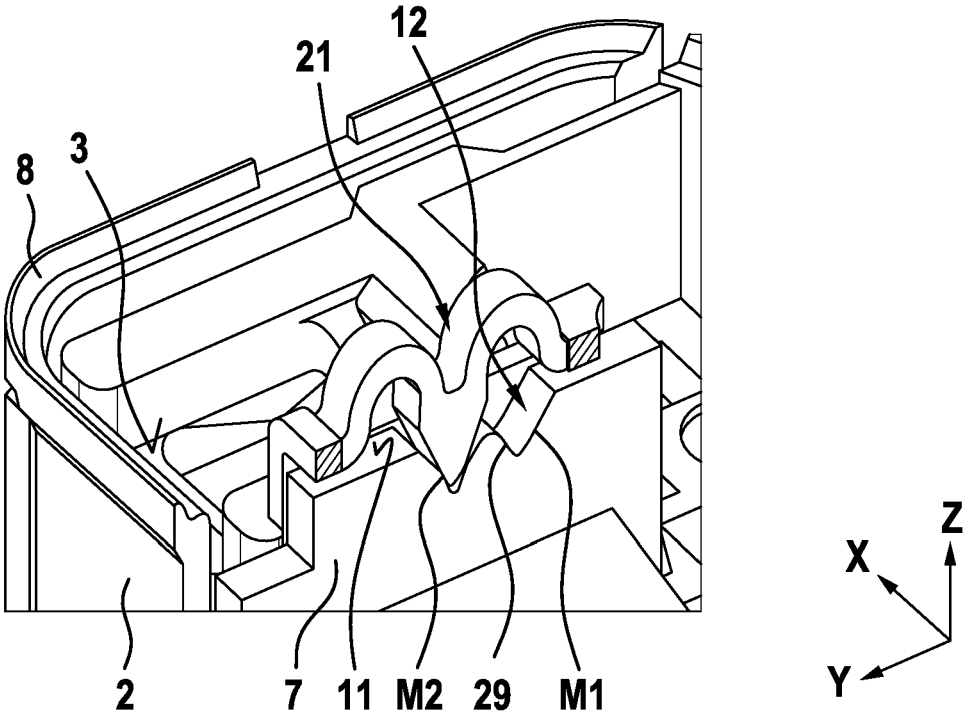

FIGS. 3*b* and 3*c* are detail views of contact locking element 20 in the first position (FIG. 3*b*) and in the second position (FIG. 3*c*) by way of a longitudinal section through wall 7. First minimum M1 and second minimum M2 are clearly evident in both Figures. In FIG. 3*c*, projections 26 disposed on the arms in the vicinity of base element 22 conceal a portion of opening 5 that is depicted.

Figure 4A:
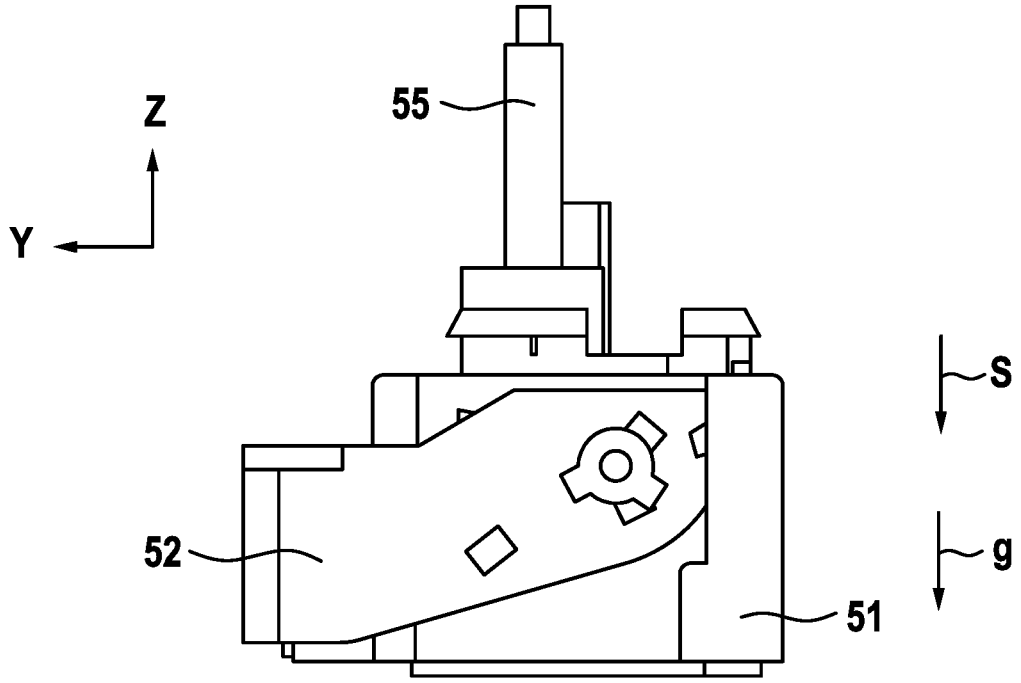
FIGS. 4*a* to 4*c* are various views of the plug connector assemblage in an installed position in which the plugging direction corresponds to the direction of gravity.
Figure 4B:
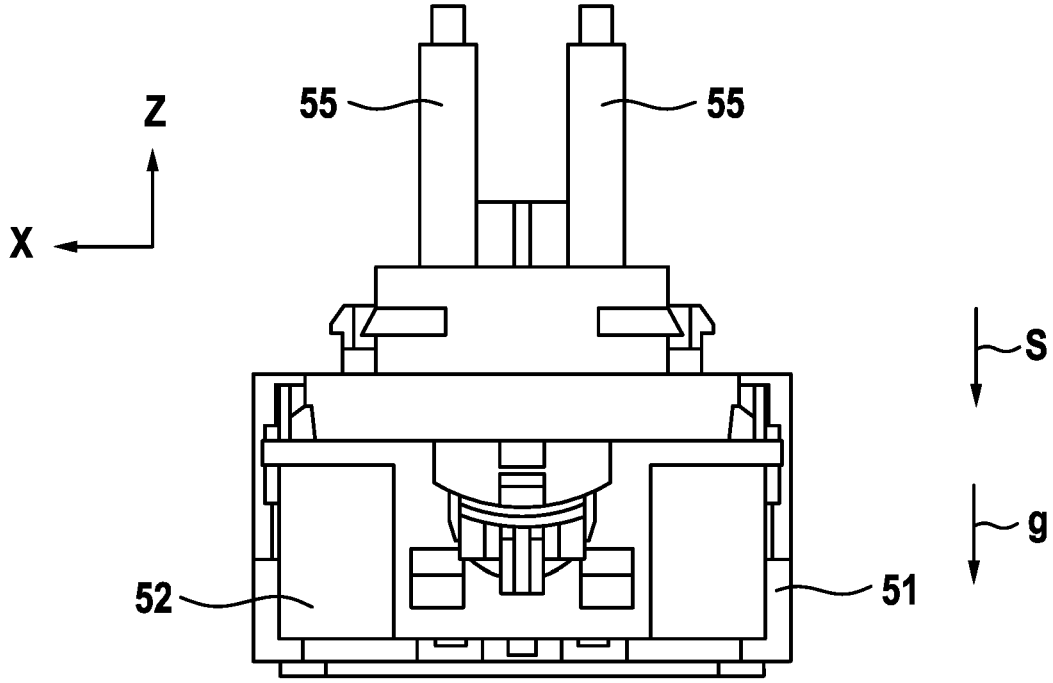

FIGS. 4*a* and 4*b* are two external views, rotated 90° with respect to one another around the Z axis, of a plug connector 1, the latter being disposed so that plugging direction S coincides with direction of gravity g. Lever 52 and external housing 51 are clearly apparent.

Figure 4C:
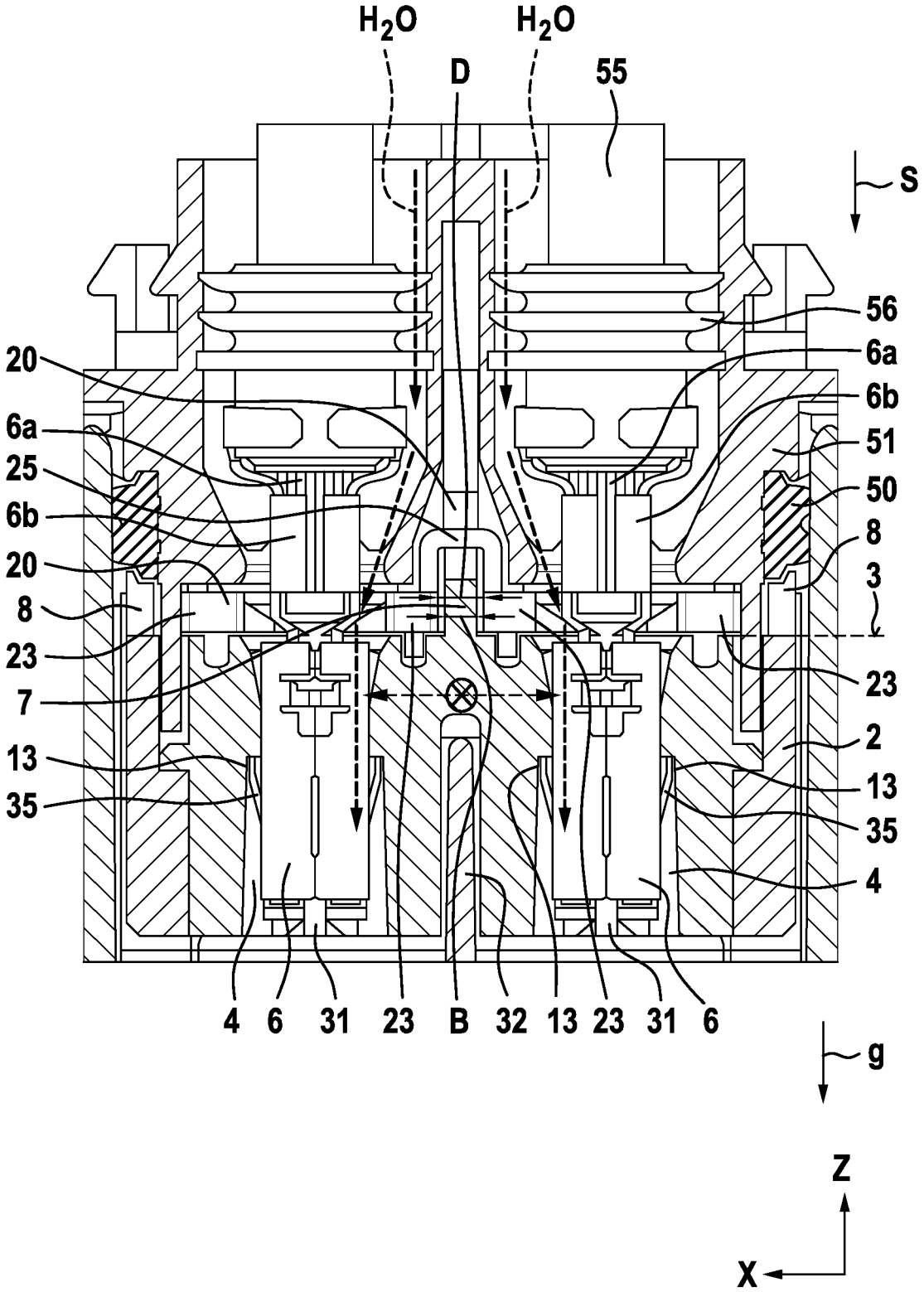

FIG. 4*c* is a cross section through FIG. 4*b* in order to illustrate the manner in which, in the context of a liquid intrusion as far as first plane 3, the infiltrating liquid or electrically conductive fluid or fluid medium is prevented, by wall 7, from short-circuiting the two contact elements 6 or the two counterpart contact elements 31. The liquid is infiltrating here, merely by way of example, through single-wire seals 56 of leads 55 of contact elements 6. The liquid, here labeled "H2O" to designate water, passes through a conically tapering opening in the lower part of external housing 51 and arrives on first plane 3 in the region of openings 5. It cannot, however, flow directly along first plane 3 on the shortest path from first opening 5 (left) to second opening 5 (right), since it is prevented from doing so here by wall 7. Instead it flows off, separately for each contact element 6 in the pertinent contact chamber 4, in response to gravity g, and can then, before creating a short circuit, be detected, for instance, by a sensor, with the result that a current shutoff can be caused. FIG. 4*c* depicts stranded wires 6*a* that electrically connect lead 55 to the pertinent contact element 6. Stranded wires 6*a* are attached here with a crimp 6*b* to the respective contact element 6.

The liquid can of course also run along wall 7 to rim 8 and then, passing through cutouts 9, flow off on outer side of housing 2.

Figure 5A:
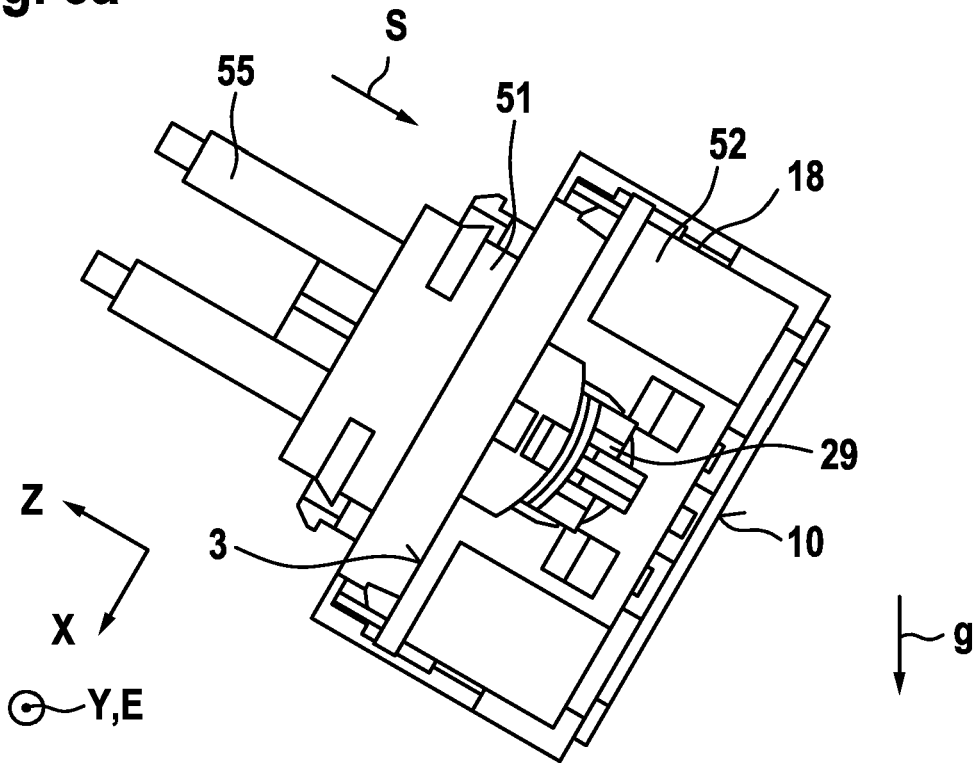
FIGS. 5*a* and 5*b* are various views of the plug connector assemblage in an installation position in which the plugging direction is tilted approximately 80° with respect to the direction of gravity.

FIG. 5*a* is a view of plug connector 1 in an installation position in which plugging direction S is tilted approximately 80° with respect to direction of gravity g. The X direction points approximately in direction of gravity g, and lever 52 faces toward the viewer. Insertion direction E emerges from the image plane toward the viewer. In this situation, liquid that penetrates as far as first plane 3 collects against wall 7, which is oriented here approximately horizontally with reference to direction of gravity g.

Figure 5B:
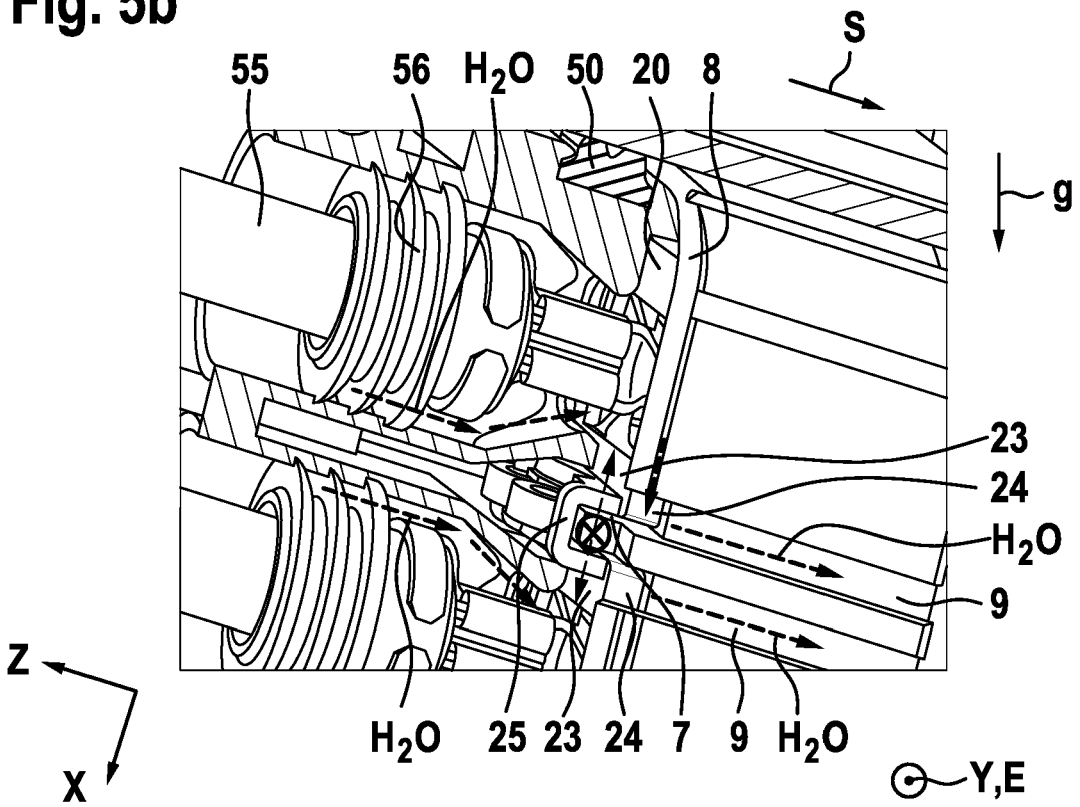

FIG. 5*b* shows the plug connector of FIG. 5*a* in a cross section through external housing 51, so that cutouts 9 on the outer side of housing 2 are directly visible.

Liquid that travels, for example, through single-wire seals 56 and reaches first plane 3 exhibits the following flow paths: liquid infiltrating at lead 55 facing closer to direction of gravity g flows, when it reaches first plane, into the first (here, lower) opening 5. Liquid infiltrating at the other (top) lead 55 follows gravity g and collects firstly in the region between first plane 3 and wall 7, where a V-shaped collecting portion is formed. The liquid cannot, however, surmount wall 7, but instead flows through cutout 9 belonging to that side of wall 7 which is now disposed at the top in the Figure and flows off there, without crossing over to the other cutout 9, along the outer wall of housing 2. A short circuit is thus effectively prevented in this installation position as well.

Figure 6A:
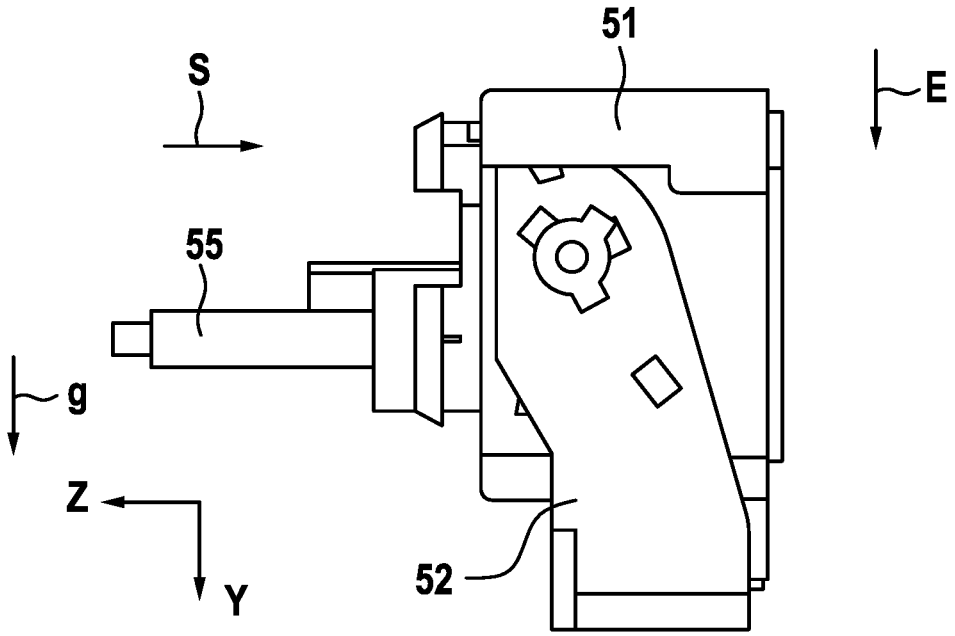
FIGS. 6*a* to 6*c* are various views of the plug connector assemblage in an installation position in which the plugging direction is tilted approximately 90° with respect to the direction of gravity, and a wall on the first plane points in the direction of gravity.
Figure 6B:
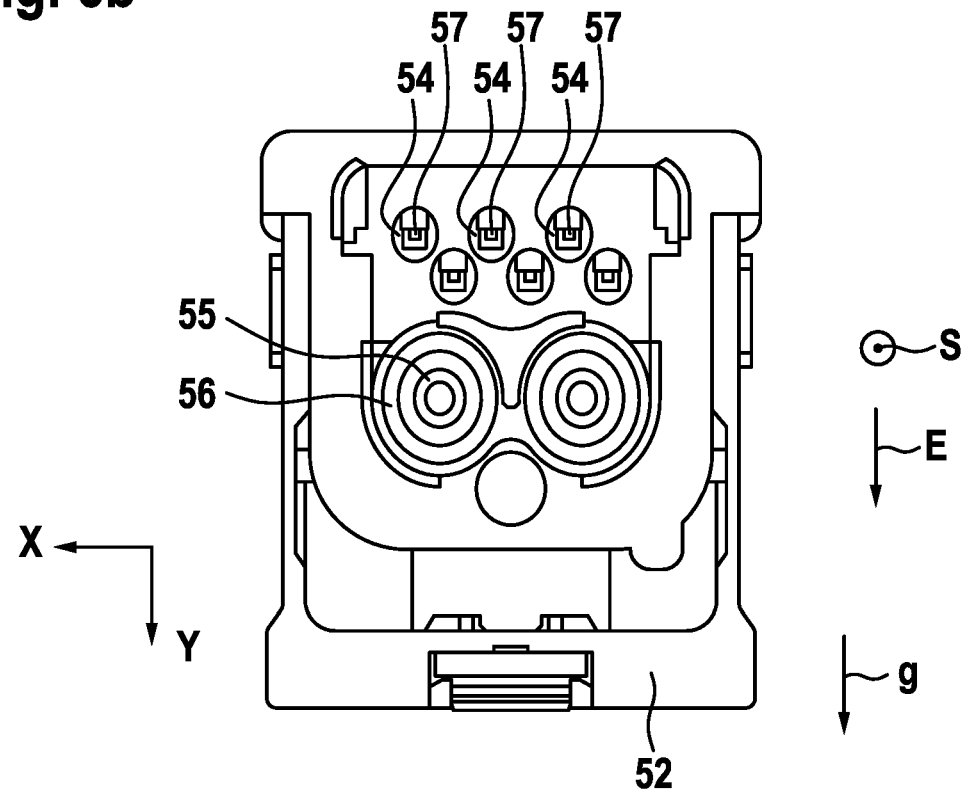

FIGS. 6*a* and 6*b* are two external views, rotated 90° around the Y axis with respect to one another, of a plug connector 1, the latter being disposed so that plugging direction S is tilted approximately 90° with respect to direction of gravity g, and wall 7 on first plane 3 points in direction of gravity g. Lever 52 points downward in direction of gravity g, as does insertion direction E.

Figure 6C:
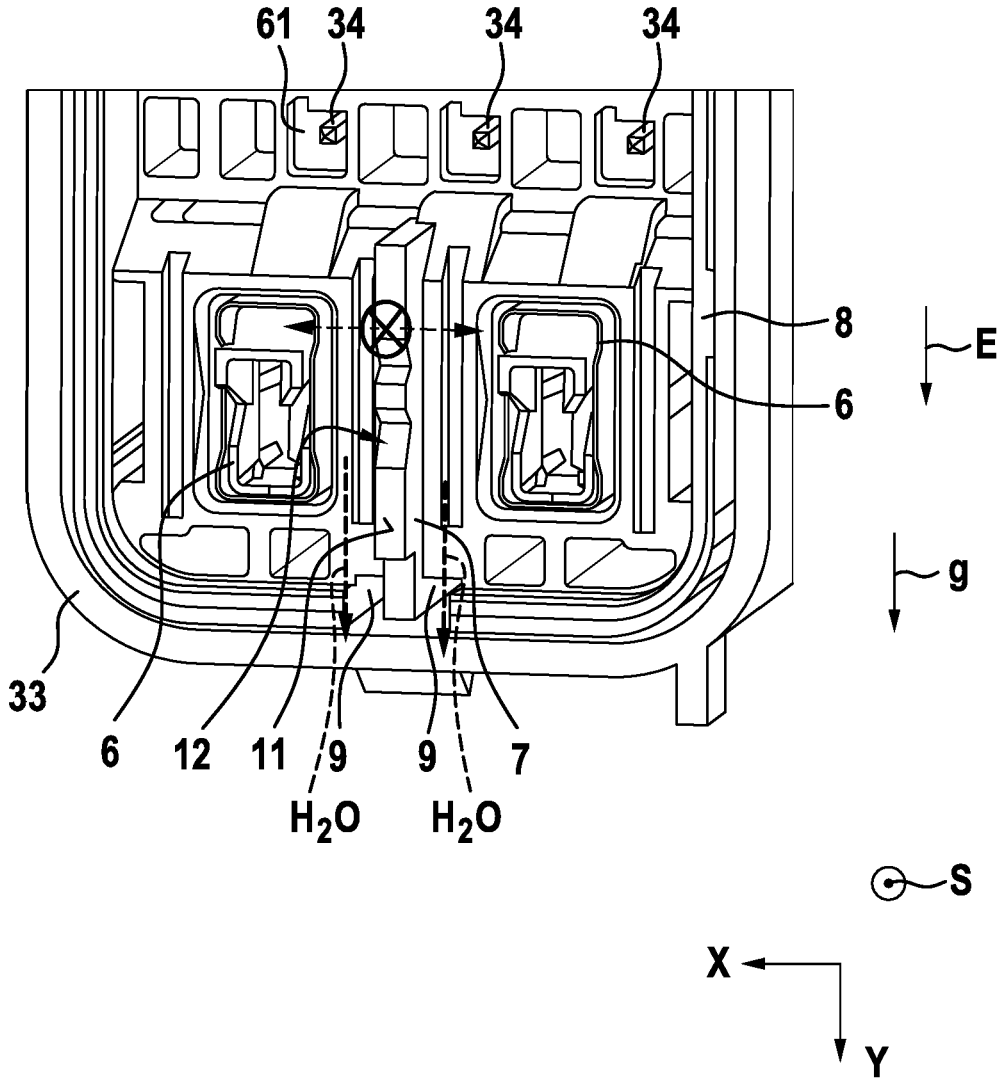

FIG. 6*c* shows the plug connector of FIGS. 6*a* and 6*b* in a cross section through external housing 51, so that first plane 3 is visible.

In this case, liquid infiltrating onto first plane 3 again cannot short circuit the adjacent contact chambers 4 over the shortest path, since it is forced by wall 7 (here standing vertically), in the manner of a sheath, to flow off downward on both sides of wall 7 and to emerge from housing 2 through cutouts 9.

It can also be shown for other installation positions of insertion connector 1 that a short circuit due to liquid on the shortest path between adjacent contact chambers 4 and contact elements 6 present therein is prevented, or at least will be delayed for a long time, by the wall (or, alternatively or additionally, the at least one groove).

If, for example, plug connector 1 of FIG. 6*c* is rotated 180° around plugging direction S, liquid then flows on first plane 3 along wall 7 (or in at least one groove) into the region of the signal contacts, where a short circuit would not have such serious consequences and would also be capable of being detected, so that the high currents at contact elements 6 could be shut off.

It is further understood that the present invention is not limited to plug connector 1 having exactly two contact chambers 4. In a context of more than two contact chambers 4, several walls 7 can be provided, each between adjacent contact chambers 4, as well as one or two cutouts 9 for each wall 7, through which liquid can flow off from first plane 3.

What is claimed is:

1. A plug connector for plugging, in a plugging direction, onto or into a counterpart plug connector, the counterpart plug connector having at least two counterpart contact elements, the plug connector comprising:

a housing having:

a first surface formed entirely in a plane and that faces against the plugging direction;

two contact chambers that are separate from each other and that each (i) has a respective opening in the first surface and (ii) is configured to receive a respective chamber contact element that is configured for electrical and mechanical contacting of a respective one of the at least two counterpart contact elements of the counterpart plug connector; and an outer rim that projects from the first surface in a direction opposite to the plugging direction and surrounds the first surface over a circumferential angle of at least 220°; and a contact locking element disposed on the first surface for locking the chamber contact elements that are introducible into the contact chambers;

wherein:

the housing further comprises:

(i) a wall that (a) protrudes from the first surface in the direction opposite to the plugging direction, (b) is disposed between the two contact chambers, and (c) extends in a radial direction, that is perpendicular to the plugging direction, towards, and cutting through, the outer rim so that there is a break in the outer rim; and/or (ii) at least one groove that (a) is disposed in the first surface between the two contact chambers and (b) extends in the radial direction towards a point of an outer edge of the first surface at which there is the break in the outer rim; and the housing has, with respect to the circumferential direction, a respective cutout on each side of the wall and/or the groove via which fluid is drainable through the break in the outer rim from inside of the housing to outside the housing while the contact locking element locks the chamber contact elements.

2. The plug connector as recited in claim 1, wherein the plug connector includes the wall, the wall projecting beyond the first surface by at least 0.25 mm.

3. The plug connector as recited in claim 1, wherein the plug connector includes the at least one groove, the at least one groove having a depth with respect to the first surface which is equal to at least 0.25 mm.

4. The plug connector as recited in claim 1, wherein the contact chambers have respective ones of the chamber contact elements disposed therein.

5. The plug connector as recited in claim 4, wherein the contact locking element is movable on the first surface, perpendicularly to the plugging direction, from a first position into a second position, wherein when the contact locking element is in the second position, the contact elements are prevented by the contact locking element from being removed from the contact chambers oppositely to the plugging direction.

6. The plug connector as recited in claim 5, wherein the contact locking element has a latch, an end face of the wall and/or the at least one groove facing opposite to the plugging direction having a form that is complementary to the latch and into which the latch latches by extending downward in the plugging direction into the wall and/or the at least one groove below the latch.

7. The plug connector as recited in claim 6, wherein:

the housing includes the wall;

the contact locking element has two arms that protrude from a base element and are at a distance from one another, perpendicularly to a direction of extension of the two arms, which is greater than a width of the wall transversely to the plugging direction;

the two arms are arranged on opposite sides of the wall when the contact locking element is latched to the wall, and the distance is at most 1 mm greater than the width of the wall.

8. The plug connector as recited in claim 7, wherein the latch includes a bridge that spans over the wall and connects respective free ends of the two arms to each other.

9. The plug connector as recited in claim 1, wherein the two contact chambers are being embodied as a passthrough opening through the housing, when viewed in the plugging direction.

10. The plug connector as recited in claim 1, wherein the plug connector includes the wall, and the wall extends along a line separating between the contact chambers that are adjacent to each other, the extension of the wall being at least along an entirety of an overlap length at which a side of a first one of the two contact chambers and a side of a second one of the two contact chambers share a coordinate of the line.

11. The plug connector as recited in claim 1, wherein the outer projects at least 0.25 mm beyond the first surface oppositely to the plugging direction.

12. The plug connector as recited in claim 11, wherein the vertically extending cutouts extend, in the plugging direction, at least from the first surface of the housing to a second surface of the housing, facing away from the first surface.

13. The plug connector as recited in claim 1, wherein, on respective sides of the wall and/or the groove, the cutouts extend vertically in the plugging direction from the first surface, at a region of the first surface at which the break in the outer rim is located, towards a second surface of the housing that is opposite to the first surface of the housing.

14. The plug connector as recited in claim 1, wherein the outer rim circumferentially extends around at least three sides of the two contact chambers, and an interior vertical surface of the outer rim is separated, by the first surface, from each of the two chambers at all of the at least three sides.

15. The plug connector as recited in claim 14, wherein the housing comprises the wall.

16. The plug connector as recited in claim 15, wherein:

the outer rim projects at least 0.25 mm above the first plane oppositely to the plugging direction;

on each of a first side of the wall and a second side of the wall:

a respective horizontally extending channel is provided in a circumferential direction; and a respective horizontally extending channel is provided in the radial direction, between the wall and a respective one of the contact chambers; and each of the horizontally extending channels on the first side of the wall opens into a first one of the cutouts and each of the horizontally extending channels on the second side of the wall opens into a second one of the cutouts.

17. An electrical plug connector assemblage, comprising:

a counterpart plug connector having at least two counterpart contact elements; and a plug connector that is plug-assembled onto or into the counterpart plug connector, is electrically contacted to the counterpart plug connector, is removable from the counterpart plug connector, is pluggable to the counterpart plug connector in a plugging direction, and comprises:

a housing having:

a first surface formed entirely in a plane and that faces against the plugging direction;

two contact chambers that are separate from each other and that each (i) has a respective opening in the first surface and (ii) is configured to receive a respective chamber contact element that is configured for electrical and mechanical contacting of a respective one of the at least two counterpart contact elements of the counterpart plug connector; and an outer rim that projects from the first surface in a direction opposite to the plugging direction and surrounds the first surface over a circumferential angle of at least 220°; and a contact locking element disposed on the first surface for locking the chamber contact elements that are introducible into the contact chambers;

wherein:

the housing further comprises:

(i) a wall that (a) protrudes from the first surface in the direction opposite to the plugging direction, (b) is disposed between the two contact chambers, and (c) extends in a radial direction, that is perpendicular to the plugging direction, towards, and cutting through, the outer rim so that there is a break in the outer rim; and/or (ii) at least one groove that (a) is disposed in the first surface between the two contact chambers and (b) extends in the radial direction towards a point of an outer edge of the first surface at which there is the break in the outer rim; and the housing has, with respect to the circumferential direction, a respective cutout on each side of the wall and/or the groove via which fluid is drainable through the break in the outer rim from inside of the housing to outside the housing while the contact locking element locks the chamber contact elements.

* * * * *